US007509702B2

(12) United States Patent
Cantis et al.

(10) Patent No.: US 7,509,702 B2
(45) Date of Patent: Mar. 31, 2009

(54) BARRICADE SYSTEM AND BARRICADE BRACKET FOR USE THEREIN

(75) Inventors: Douglas Mark Cantis, Morgantown, WV (US); Eugene Anthony McKenzie, Jr., Morgantown, WV (US); Thomas Gordon Bobick, Morgantown, WV (US); Herbert David Edgell, III, Morgantown, WV (US)

(73) Assignee: The United States of America as represented by the Secretary of the Department of Health and Human Services, c/o Centers for Disease Control and Prevention, Washington, DC (US)

( * ) Notice: Subject to any disclaimer, the term of this patent is extended or adjusted under 35 U.S.C. 154(b) by 531 days.

(21) Appl. No.: 11/257,472

(22) Filed: Oct. 24, 2005

(65) Prior Publication Data

US 2007/0090232 A1 Apr. 26, 2007

(51) Int. Cl.
*E04G 3/00* (2006.01)
*E04G 7/00* (2006.01)
*E01D 21/00* (2006.01)

(52) U.S. Cl. ..... 14/78; 182/45; 182/113; 256/65.01; 248/205.1; 248/235; 248/242

(58) Field of Classification Search ..... 248/237, 248/205.1, 235, 242; 404/6, 9, 10; 14/78; 182/45, 113; 256/65.02
See application file for complete search history.

(56) References Cited

U.S. PATENT DOCUMENTS 1,043,838 A * 11/1912 Howard ..... 248/237
1,864,457 A * 6/1932 Nelson ..... 248/237
2,329,415 A * 9/1943 Osborne ..... 248/237
3,164,353 A * 1/1965 Rene ..... 248/237
5,113,971 A * 5/1992 Violet ..... 182/45
5,154,256 A * 10/1992 Wood ..... 182/113
5,188,342 A 2/1993 Ouellette et al.
5,318,148 A * 6/1994 Franco et al. ..... 182/45
D368,647 S 4/1996 Koebbe
5,503,358 A * 4/1996 Lapp ..... 248/235
5,515,941 A 5/1996 Palmer et al.
5,647,451 A 7/1997 Reichel
5,657,968 A * 8/1997 Marsden ..... 256/68
5,711,398 A 1/1998 Bartholomew
5,896,944 A 4/1999 McMillian et al.
6,045,102 A * 4/2000 Terenzoni ..... 248/238
6,053,281 A 4/2000 Murray
7,195,099 B2 * 3/2007 Harney ..... 182/45
2004/0103589 A1 6/2004 Purvis et al.

(Continued)

OTHER PUBLICATIONS

Acro Building Systems website, "Roofing Guardrail System #12070," http://www.acrobuildingsystems.com/rgs%2012070.htm, 4 pages.

(Continued)

*Primary Examiner*—Raymond W Addie
(74) *Attorney, Agent, or Firm*—Klarquist Sparkman, LLP

(57) ABSTRACT

A protective barricade system to prevent persons from accidentally falling through holes in roofs or floors or from the edges of stairwells, balconies, or pitched roofs. The barricade system comprises a plurality of barricade brackets that are spaced apart and can be releasably attached to the underlying surface.

45 Claims, 7 Drawing Sheets

U.S. PATENT DOCUMENTS

2006/0243524 A1* 11/2006 Jarrell ..... 182/82

OTHER PUBLICATIONS

AJC Tools and Equipment website, "AJC Roof Brackets," http://www.ajctools.com/brackets.html, 1 page.
Fulton Corporation website, Roof and Ladder products, http://www.fultoncorp.com/RoofandLadder.html, 2 pages.
Protective Roofing Products Ltd. website, "Model: PR-20," http://www.prplimited.com/products.asp?product=1, 1 page.
Protective Roofing Products Ltd. website, "Model: PR-100," http://www.prplimited.com/products.asp?product=2, 1 page.
Protective Roofing Products Ltd. website, "Model: PR-2000," http://www.prplimited.com/products.asp?product=7.
Qual-Craft Industries, Inc. website, "Roofing Products Family," http://www.qualcraft.com/ROOFING.html, 4 pages.

* cited by examiner

BARRICADE SYSTEM AND BARRICADE BRACKET FOR USE THEREIN

FIELD OF THE INVENTION

The invention relates to the protection of workers at construction sites. More particularly, the invention relates to a barricade system that can be positioned about a stairwell opening or some other hole in a roof or floor, on the surface of a pitched roof that is undergoing construction or maintenance, and/or along an unprotected edge, such as a balcony. The barricade system is installed to prevent a worker from accidentally falling through such a hole, off the edge of a flat or pitched roof, or from the edge of an elevated work area.

BACKGROUND

Workers involved in the construction or maintenance repair of buildings risk serious injury or fatality if they should lose their balance and fall off the edge of a roof or a walking-working surface, or into a hole in the floor or roof. Injuries and fatalities caused by falls from unguarded roof edges, through roof and floor holes, or through unprotected skylight fixtures are some of the most severe and costly categories of injury in all U.S. private industry. One estimate indicates that slips and falls injuries are at least a $5.7 billion/year construction industry problem. In response, various safety systems have been proposed over the years and the Occupational Safety and Health Administration (OSHA) has promulgated regulations specifically requiring employers to provide fall protection to workers.

Current OSHA regulations for the construction industry are contained in 29 CFR (Code of Federal Regulations) Part 1926. Specifically, Subpart M, which includes Sections 1926.500 through 1926.503 and Appendices A through E, lists the requirements that are related to workplace falls. Section 1926.501 discusses the requirements for fall protection. Subsection 1926.501(b)(1) states that "Each employee on a walking/working surface (horizontal and vertical surface) with an unprotected side or edge which is 6 feet (1.8 m) or more above a lower level shall be protected from falling by the use of guardrail systems, safety net systems, or personal fall arrest systems." Subsection 1926.501(b)(4)(i) states that "Each employee on walking/working surfaces shall be protected from falling through holes (including skylights) more than 6 feet (1.8 m) above lower levels, by personal fall arrest systems, covers, or guardrail systems erected around such holes." In addition, subsection 1926.502(b) states that:

Guardrail systems and their use shall comply with the following provisions:

(1) Top edge height of top rails, or equivalent guardrail system members, shall be 42 inches (1.1 m) plus or minus 3 inches (8 cm) above the walking/working level . . . .

(2)(i) Midrails, when used, shall be installed at a height midway between the top edge of the guardrail system and the walking/working level. . . .

(3) Guardrail systems shall be capable of withstanding, without failure, a force of at least 200 pounds (890 N) applied within 2 inches (5.1 cm) of the top edge, in any outward or downward direction, at any point along the top edge. . . .

(4) When the 200 pound (890 N) test load . . . is applied in a downward direction, the top edge of the guardrail shall not deflect to a height less than 39 inches (1.0 m) above the walking/working level. Guardrail system components selected and constructed in accordance with Appendix B [of] Subpart M . . . will be deemed to meet this requirement.

(5) Midrails . . . shall be capable of withstanding, without failure, a force of at least 150 pounds (666 N) applied in any downward or outward direction at any point along the midrail . . . .

(6) Guardrail systems shall be so surfaced as to prevent injury to an employee from punctures or lacerations, and to prevent snagging of clothing.

(7) The ends of all top rails and midrails shall not overhang the terminal posts, except where such overhang does not constitute a projection hazard. . . .

(11) When guardrail systems are used at holes, they shall be erected on all unprotected sides or edges of the hole.

(12) When guardrail systems are used around holes used for the passage of materials, the hole shall not have more than two sides provided with removable guardrail sections to allow the passage of materials. When the hole is not in use, . . . a guardrail system shall be provided along all unprotected sides or edges. . . .

(14) Guardrail systems used on ramps and runways shall be erected along each unprotected side or edge.

Attempts have been made in the past to solve this problem, but such past devices have either not been adjustable to a wide variety of roof pitches, use a pitch adjustment mechanism that presents a potential point of failure, are difficult to set up and remove, or are overly complex. Thus, there remains a need for a portable barricade system that meets OSHA requirements, is easy to set up and remove, is adjustable to the respective pitch of the underlying surface, is solidly constructed, and is collapsible so as to be easily transportable between job sites.

SUMMARY

The present invention provides a novel and versatile barrier system that achieves the above-mentioned goals and can be installed and removed without the need to modify the underlying structure, such as, for example, a roof structure. The barricade system can be readily used in residential construction and the construction of sloped-roof structures in general, with additional application in flat (low-slope) structures and non-roof applications (leading edge work) in residential or industrial construction.

In one aspect, the invention may be defined as a barrier system comprising at least one barricade bracket that permits the easy installation of protective guardrails, toe boards, and work surfaces on roofs and other surfaces over a wide pitch range. Each barricade bracket comprises a base member, a support member and a step member that can be fixed relative to each other such that the step member can be selectively and releasably positioned at a plurality of predetermined angles with respect to the base member.

In use, the protective barricade system is easily installed at roof edges and around holes or skylights on flat (low-slope) commercial/industrial roofs, and on sloped residential roofs with pitches ranging between 18° (4:12) to 63° (24:12). The barricade system's set pitches are 27° (6:12), 34° (8:12), and 40° (10:12) to 45° (12:12), 51° (15:12), 56° (18:12), and 63° (24:12). Roof slopes between these set pitches can also be accommodated, with the step member of the barricade bracket having a few-degree pitch toward the roof surface when used on non-standard pitches. The barricade system of the present invention allows for the installation of the three-member guard rail required by OSHA standards (top rail, midrail and toe-board), as well as the installation of support planks ranging from 2"×6" to 2"×12". The 12" wide plank provides for a large walking/working area, comparable to the widest such surfaces available in the industry today.

In one embodiment, the barricade bracket can be mounted directly on the surface of the roof to the underlying roof truss member and therefore enables a greater freedom of placement than do current devices that require rail placement either at the roof edge or at the seams between overlay sheets at four-foot intervals. The barricade system of the present invention can be used in various configurations, from simply supporting a plank for a horizontal work surface on a sloped roof, or as a set of stairs ascending the roof, to a plank and toe board combination, or a full safety railing and perimeter protection system that can be installed anywhere in a residential or industrial/commercial construction site. For a residence, this would range from the first floor (such as, for example, protecting an opening to the basement), to the second floor (such as, for example, protecting an unguarded balcony edge), to the peak of the roof. For industrial/commercial buildings, the barricade system can be used to protect unguarded holes that are waiting for construction to be completed (such as, for example, elevator shaft openings on consecutive floors, or openings on consecutive floors for heating, ventilation, and air conditioning ductwork). An additional important usage would be as a set of handrails on an unprotected set of steps in any type of construction.

In one aspect, the barricade system also includes a pole that includes a bend at one end. The pole can be connected to the barricade bracket to provide a substantially vertical support pole in both flat and sloped configurations. Moreover, in exemplary embodiments, the use of fasteners to set the angle of the barricade bracket and means for setting the rail or barrier height allows for easy and convenient manipulation of the barricade bracket and rail or barrier placement and configuration. Thus, the barricade system allows for maximum versatility and provides safe work conditions in a variety of work situations.

DETAILED DESCRIPTION OF THE DRAWINGS

The accompanying drawings, which are incorporated in and constitute a part of this specification, illustrate certain aspects of the instant invention and together with the description, serve to explain, without limitation, the principles of the invention. These and other features of the embodiments of the invention will become more apparent in the following detailed description in which reference is made to the appended drawings wherein.

DETAILED DESCRIPTION OF THE INVENTION

Figure 1:
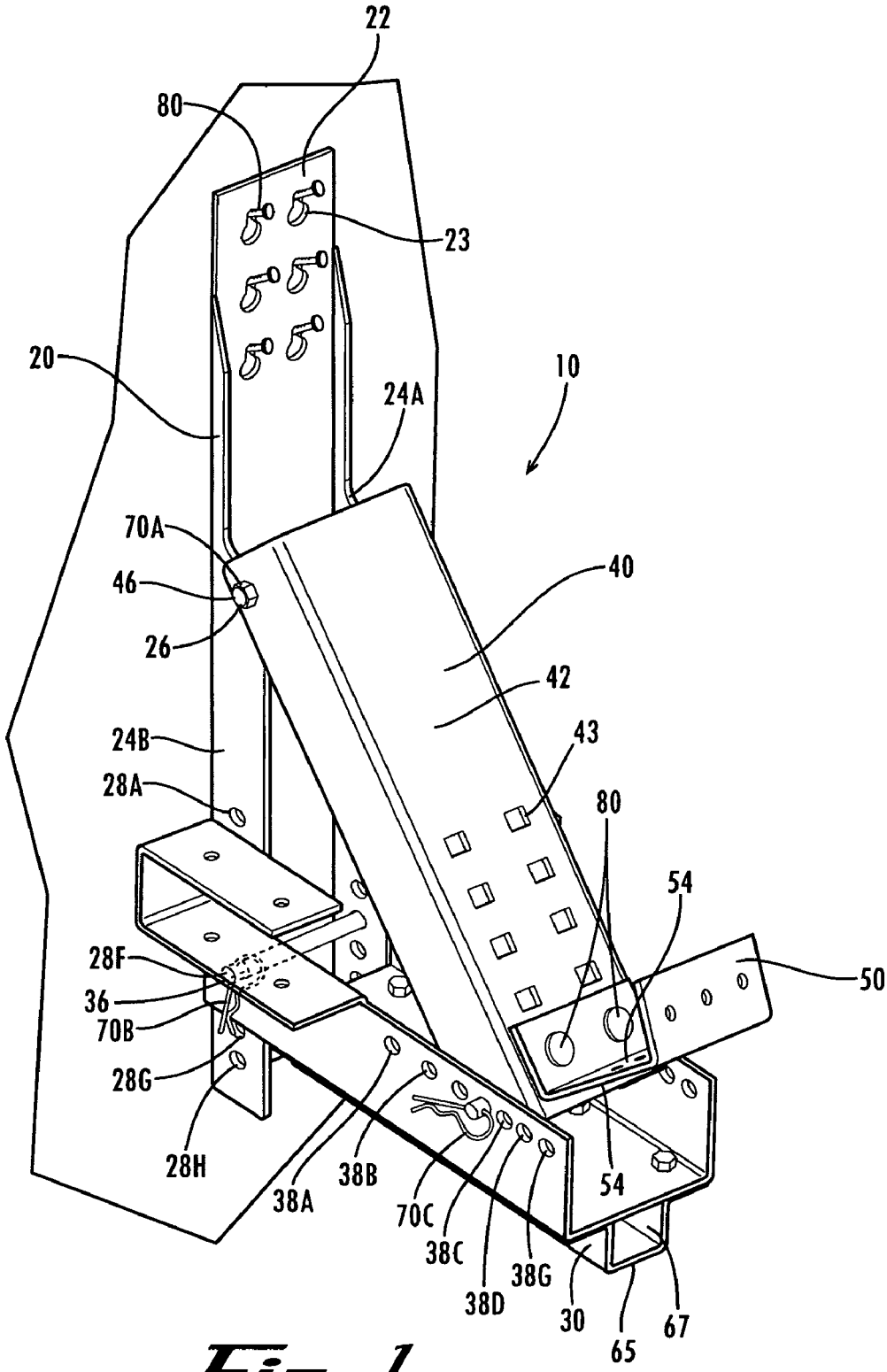
FIG. 1 is a perspective view of an embodiment of a barricade bracket of the present invention for use in a barricade system.
Figure 2:
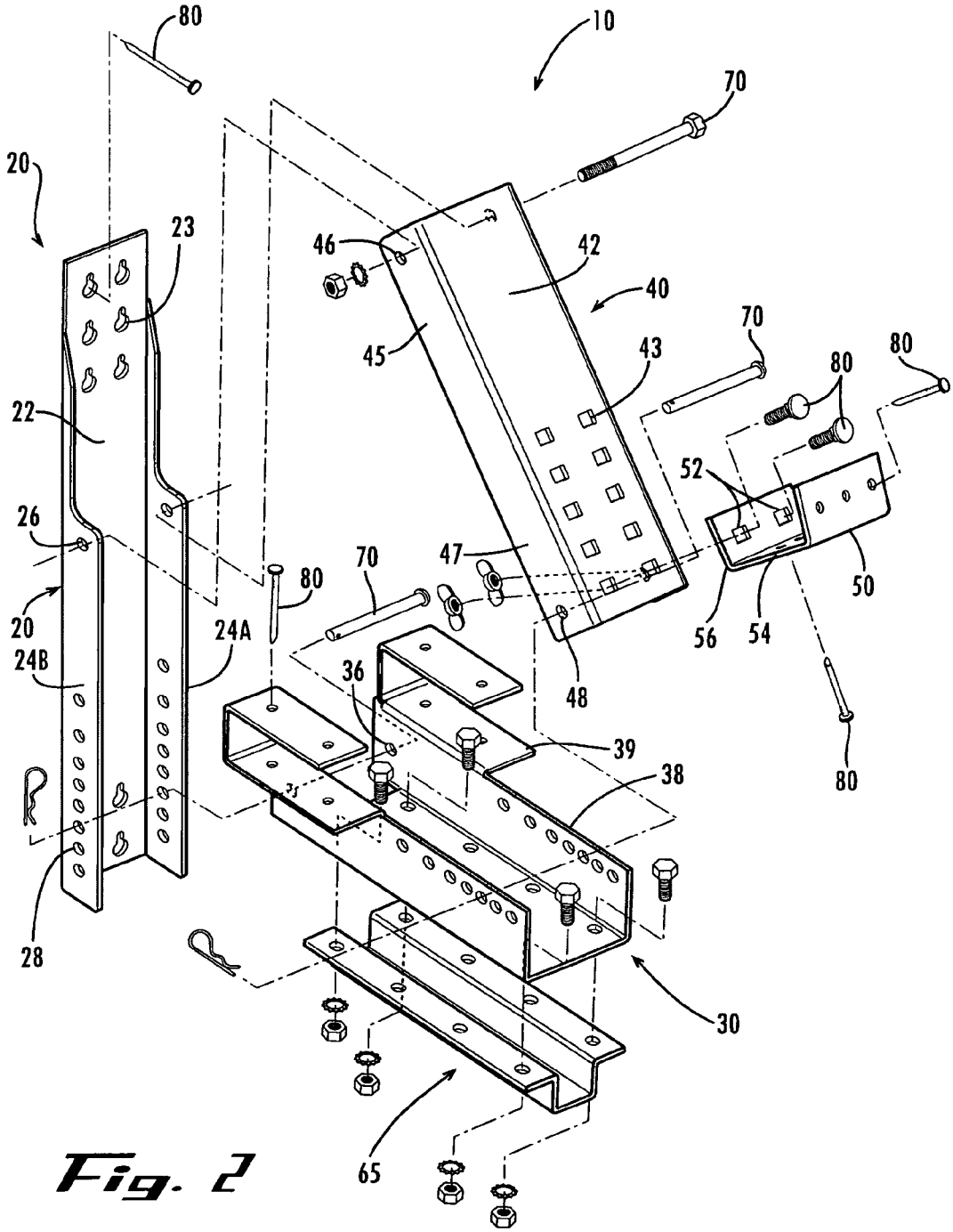
FIG. 2 is an exploded view of the barricade bracket of FIG. 1.
Figure 3:
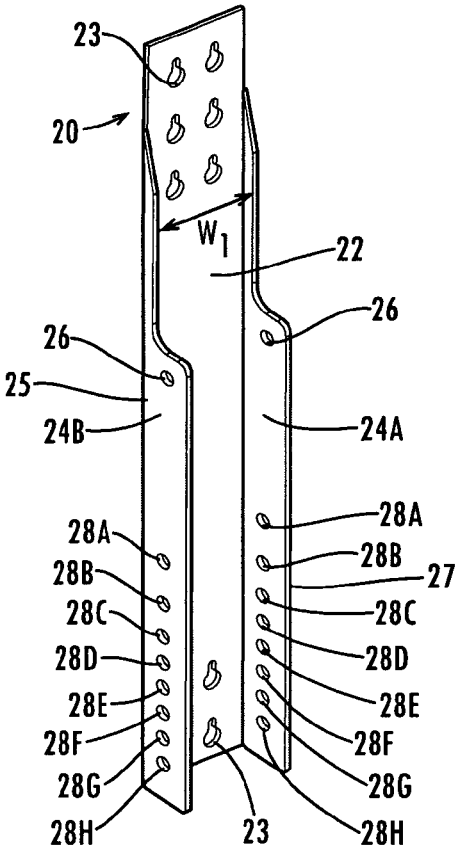
FIG. 3 is a perspective view of a base member of the barricade bracket of FIG. 1.
Figure 4:
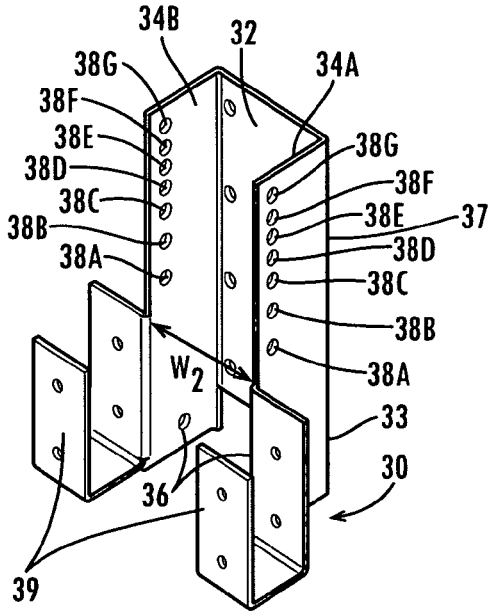
FIG. 4 is a perspective view of a support member of the barricade bracket of FIG. 1.
Figure 5:
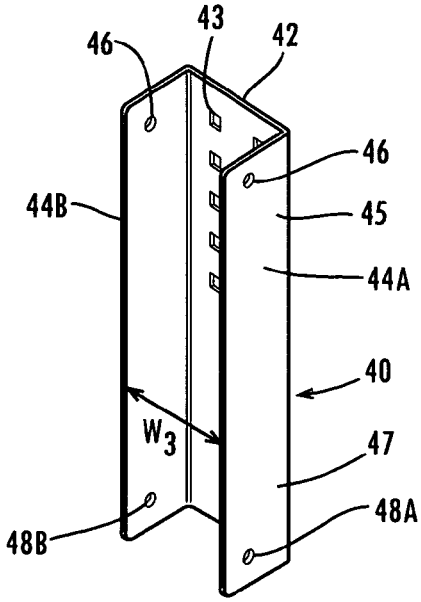
FIG. 5 is a perspective view of a step member of the barricade bracket of FIG. 1.
Figure 6:
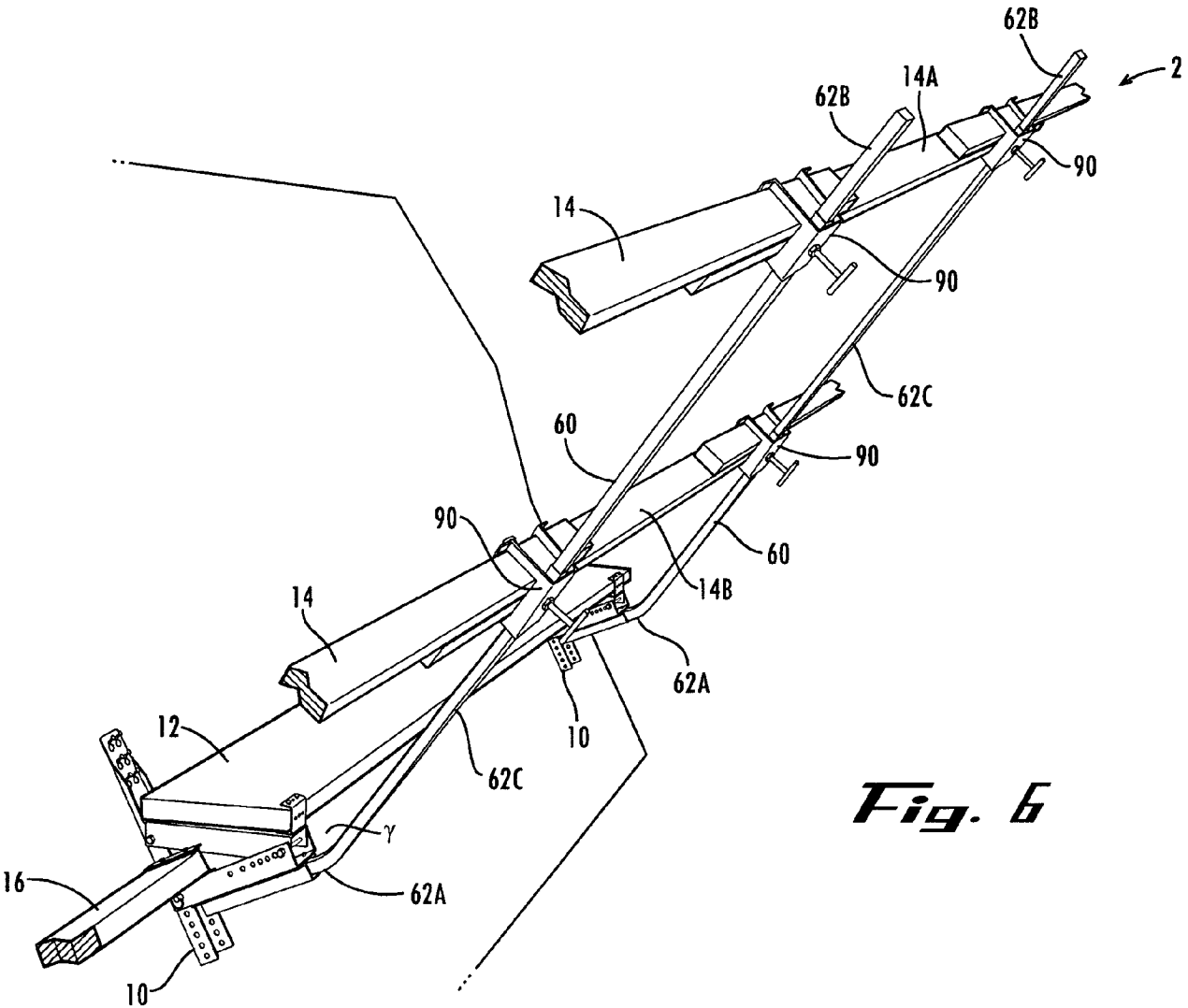
FIG. 6 is a perspective view of the barricade system of the present invention mounted onto a portion of a pitched roof, showing a pole mounted to the barricade bracket of FIG. 1 and showing a rail assembly mounted to a portion of the pole.
Figure 7:
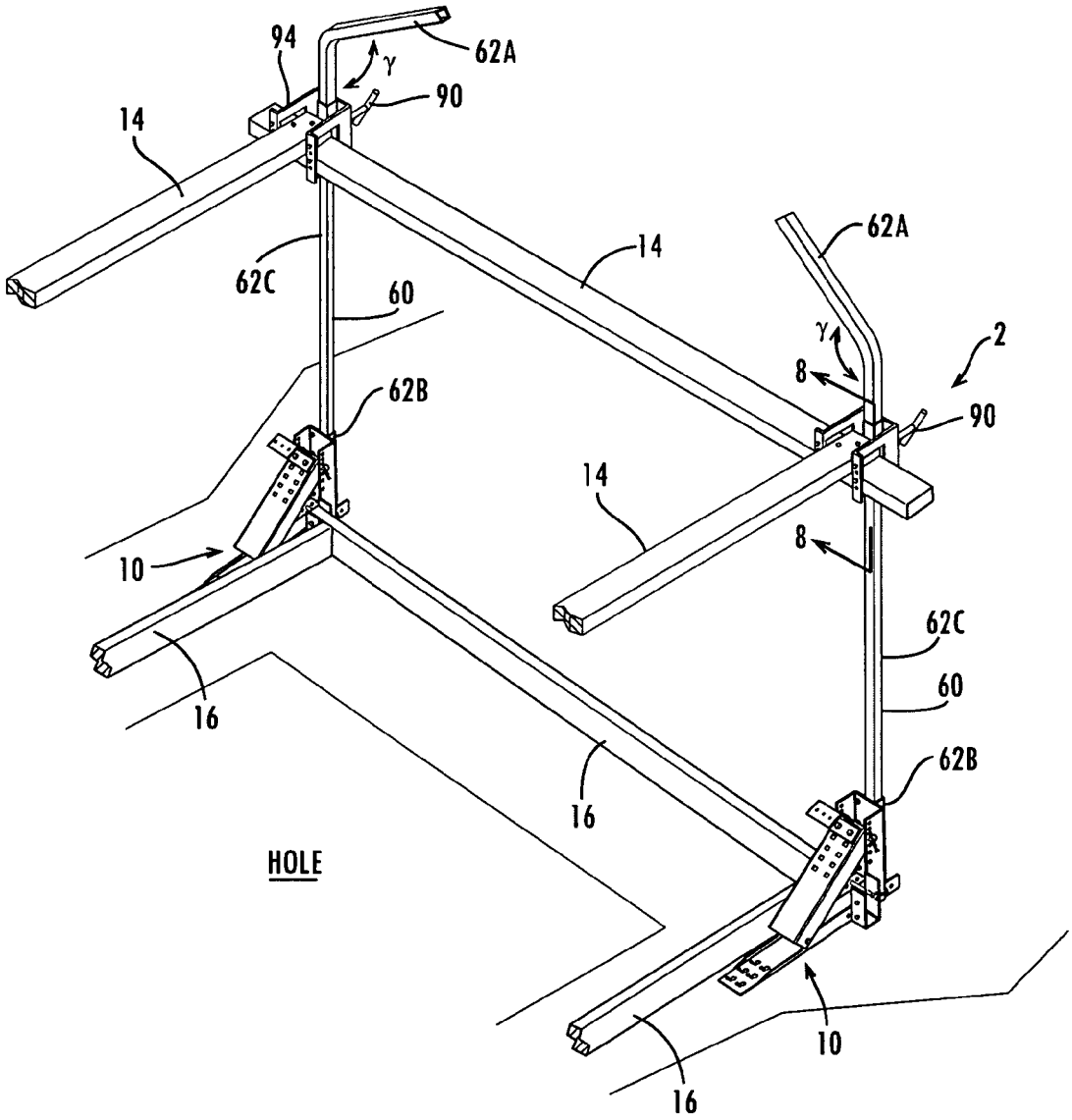
FIG. 7 is a perspective view of the barricade system of the present invention positioned about a portion of a hole in a structure.
Figure 8:
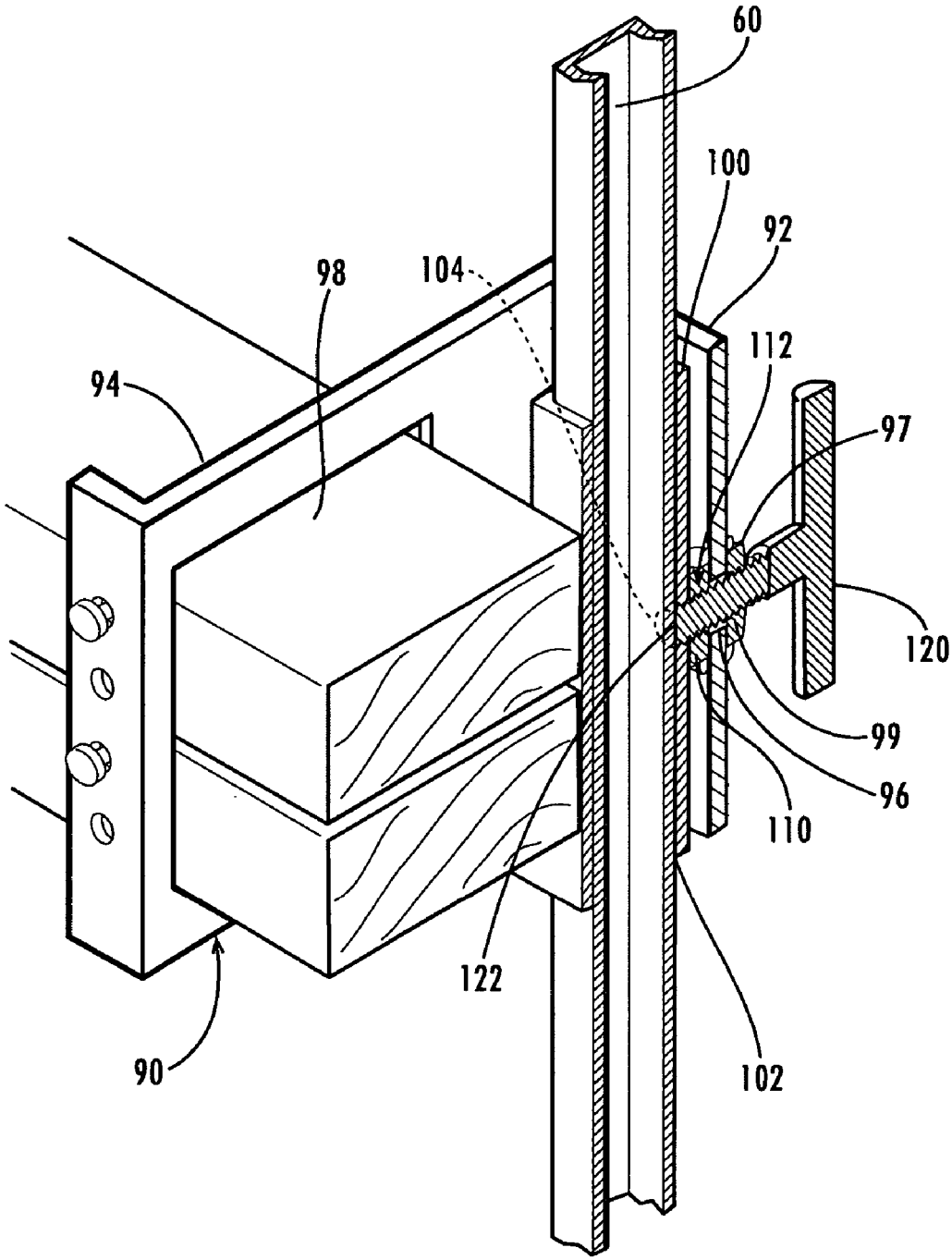
FIG. 8 is a perspective cross-sectional view of a rail assembly of the present invention releaseably mounted to a portion of the pole.
Figure 9:
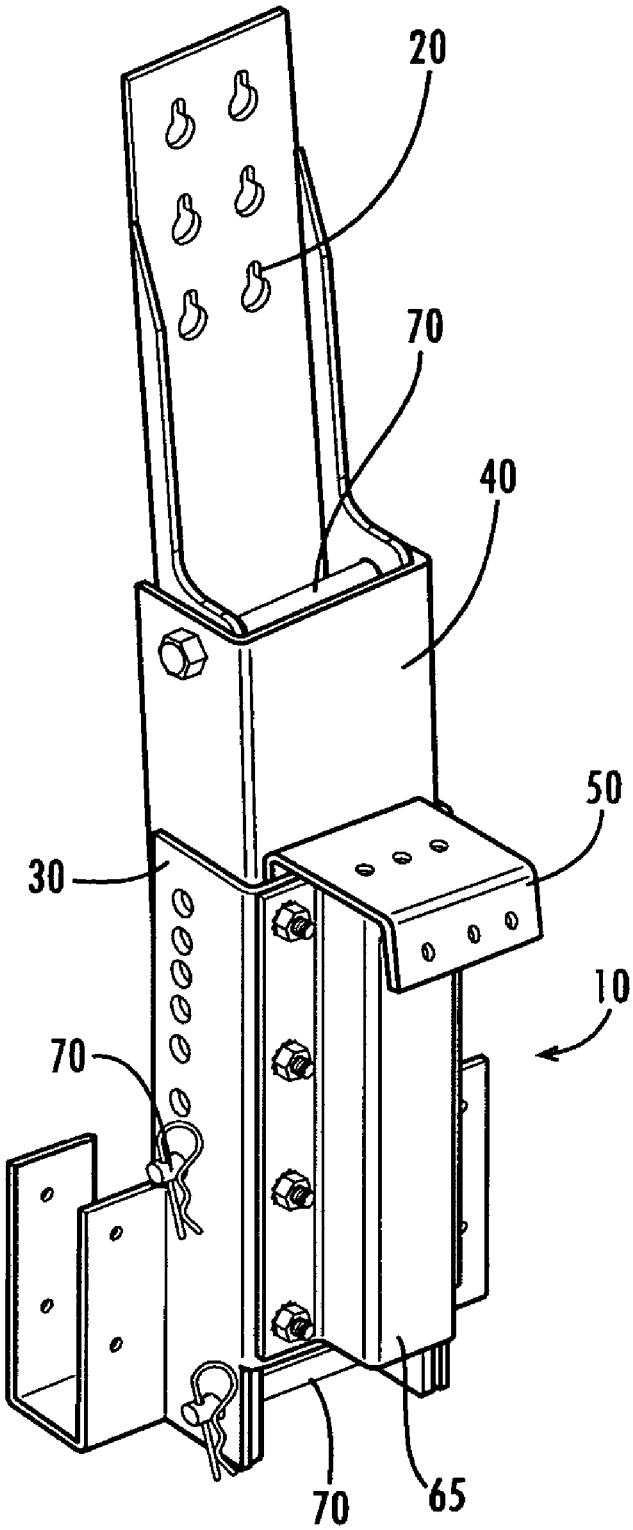
FIG. 9 is a perspective view of the barricade bracket of FIG. 1 in a storable position.

The present invention can be understood more readily by reference to the following detailed description, examples, and claims, and their previous and following description.

Before the present systems, devices, and/or methods are disclosed and described, it is to be understood that this invention is not limited to the specific articles, devices, and/or methods disclosed unless otherwise specified, as such, and can, of course, vary. It is also to be understood that the terminology used herein is for the purpose of describing particular aspects only and is not intended to be limiting.

The following description of the invention is provided as an enabling teaching of the invention in its best, currently known embodiment. Those skilled in the relevant art will recognize that many changes can be made to the embodiments described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof. It is particularly noted that it is contemplated that alternative scaled devices of the present invention can be derived from the exemplary, and not meant to be limiting, dimensions provided herein in an exemplary embodiment of the present invention.

As used herein, the singular forms "a," "an" and "the" include plural referents unless the context clearly dictates otherwise. Thus, for example, reference to a "barricade bracket" includes aspects having two or more barricade brackets unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The present invention provides a protective barricade system 2 that can be secured to an underlying surface at least partially surrounding a roof or floor opening or on a pitched roof. A conventional pitched roof includes an underlying truss structure formed by inclined, generally parallel, spaced apart joists that run generally perpendicular to the roof edge, and a plywood overlay on the joists that are formed by successive courses of sheet overlay, such as, for example and not meant to be limiting, plywood sheets. The first course of sheet typically begins adjacent the roof edge while successive courses progress upwardly toward the apex of the roof. As noted above, conventional sloped residential roofs have typical pitches ranging between 27° (6:12), 34° (8:12), and 40° (10:12) to 45° (12:12), 51° (15:12), 56° (18:12), and 63° (24:12). Of course, other customized pitches that vary from the typical pitches can be accommodated by the barricade system of the present invention.

In an exemplary use on a roof, the barricade system 2 of the present invention can comprise a plurality of barricade brackets 10 that are spaced apart along the roof. The purpose of the barricade brackets is to provide a trustworthy support for barricades, such as, for example, rails, that are positioned at the mandated OSHA regulation heights. In one exemplified embodiment, each barricade bracket 10 comprises a base member 20, a support member 30, a step member 40, and a plurality of shafts or fasteners 70.

The base member 20 of the barricade bracket comprises an anchor plate 22 and a pair of opposing base side members 24A, 24B that extend from opposing edge portions of the anchor plate. In one exemplary aspect, at least a portion of the base member 20 defines a U-shaped channel. In one aspect, the anchor plate 22 of the base member defines a plurality of anchor openings 23 that are adapted to receive a fastener 80, such as, for example and not meant to be limiting, a nail, a screw, a bolt, and the like, for releasable connection to the underlying surface. The anchor plate 22 has a first width $w_1$, which is transverse to the longitudinal axis of the base member. In one example, the first width $w_1$ is about 2.75 inches.

Each base side member 24A, 24B defines a first opening 26 and at least one second opening 28 such that the pair of opposing base side members defines a first pair of opposing first openings 26 and a spaced at least one second pair of opposing second openings 28. In one example, the first opening of each base side member is spaced from the at least one second opening. In a further aspect, the first opening 26 is positioned on a top portion 25 of the base side member, and, in an alternative aspect, the at least one second opening 28 is positioned on a bottom portion 27 of the base side member.

In one example, the at least one second opening 28 comprises a plurality of second openings. The plurality of second openings can extend linearly substantially parallel to a longitudinal axis of the base member. In one aspect, each of the plurality of second openings is spaced from an adjacent second opening a predetermined distance. It is contemplated that the predetermined distance between each of the second openings is substantially uniform or is variable. Alternatively, it is contemplated that the predetermined distance varies between at least two of the second openings of the plurality of second openings.

For example and not meant to be limiting, the second opening 28A is spaced from the first opening 26 about 4.54 inches; the second opening 28B is spaced from the first opening 26 about 5.57 inches; the second opening 28C is spaced from the first opening 26 about 6.37 inches; the second opening 28D is spaced from the first opening 26 about 7.04 inches; the second opening 28E is spaced from the first opening 26 about 7.63 inches; the second opening 28F is spaced from the first opening 26 about 8.25 inches; the second opening 28G is spaced from the first opening 26 about 8.88 inches; and the second opening 28H is spaced from the first opening 26 about 9.50 inches.

The support member 30 of the barricade bracket 10 comprises a back plate 32 and a pair of opposing support side members 34A, 34B that extend from opposing edge portions of the back plate. In one exemplary aspect, at least a portion of the support member 30 defines a U-shaped channel that has a second width $w_2$, which is transverse to the longitudinal axis of the support member and which is greater than the first width $w_1$ of the base member. In one example, the second width $w_2$ is about 3.25 inches.

In a further aspect, the pair of opposing support side members 34A, 34B define a third pair of opposing third openings 36 and a spaced at least one fourth pair of opposing fourth openings 38. In this aspect, each support side member defines a third opening 36 and at least one fourth opening 38 that is spaced from the third opening. In one example, the third opening 36 is positioned adjacent a lower portion 33 of the support side member and the at least one fourth opening 38 is positioned on an upper portion 37 of the support side member.

In an exemplary aspect, the at least one fourth opening 38 comprises a plurality of fourth openings. In this aspect, the plurality of fourth openings can extend linearly substantially parallel to the longitudinal axis of the support member. Each of the plurality of fourth openings is spaced from an adjacent fourth opening a predetermined distance that can be substantially uniform or can be variable. In one example, the predetermined distance varies between at least two of the fourth openings of the plurality of fourth openings.

For example and not meant to be limiting, the fourth opening 38A is spaced from the third opening 36 about 4.50 inches; the fourth opening 38B is spaced from the third opening 36 about 5.53 inches; the fourth opening 38C is spaced from the third opening 36 about 6.33 inches; the fourth opening 38D is spaced from the third opening 36 about 6.96 inches; the fourth opening 38E is spaced from the third opening 36 about 7.55 inches; the fourth opening 38F is spaced from the third opening 36 about 8.12 inches; and the fourth opening 38G is spaced from the third opening 36 about 8.70 inches.

In a further aspect, the support member 30 of the barricade bracket further comprises at least one U-shaped trough member 39. In this aspect, one side of the trough member is connected to a portion of an upper edge of the support side member. In one example, the side of the trough member is connected to a lower portion 33 of the upper edge of the support side member. In another example, the closed bottom portion of the trough is oriented downwardly toward the lower portion 33 of the support side member. In another example, the closed bottom portion of the trough member 39 can be positioned adjacent the third opening 36 of the support member. The at least one trough member 39 is adapted to seat or mount a board, such as, for example, a conventional stock piece of lumber therein such that the board is positioned in a plane substantially parallel to the back plate of the support member. In one aspect, the at least one trough member 39 comprises an opposed pair of trough members. In this aspect, each trough member 39 extends from opposing edges of the opposing support side members 34A, 34B. In a further aspect, each trough member defines at least one opening that is adapted to receive a fastener such that a toe board can be releaseably mounted therein the trough member 39.

The step member 40 of the barricade bracket comprises a top plate 42 and a pair of opposing step side members 44A, 44B that extend from opposing edge portions of the top plate. The pair of opposing step side members defining a fifth pair of opposing fifth openings 46 and a spaced sixth pair of opposing sixth openings 48. In one aspect, each step side member defines a fifth opening 46 and a spaced sixth opening 48. In one example, the fifth opening is positioned adjacent a proximal end 45 of the step side member and the sixth opening is positioned adjacent a distal end 47 of the step side member. In one example and not meant to be limiting, the fifth opening is spaced from the sixth opening about 9.5 inches. In one exemplary aspect, at least a portion of the support member 40 defines a U-shaped channel that has a third width $w_3$, which is transverse to the longitudinal axis of the support member and which is greater than the first width $w_1$ of the base member and less than the second width $w_2$ of the support member. In one example, the third width $w_3$ is about 3.0 inches.

In one aspect, the top plate 42 of the step member defines a plurality of mount openings 43 that are adapted to receive a fastener 80, such as, for example and not meant to be limiting, a nail, a screw, a bolt, and the like. In one example, the mount openings 43 can be used for releasable connection of a support plank 12 directly to the top plate 42 of the step member. In an alternative embodiment, the step member can further comprise a shoulder member 50 that defines at least one opening 52, which is adapted to receive the fastener. Thus, in use, the shoulder member 50 can be selectively connected to the top plate 42 of the step member. Further, the shoulder member can comprise a stop 54 that extends substantially transverse from a distal end 56 of the shoulder member. In use, the support plank 12 can be positioned thereon the shoulder member and against at least a portion of the stop. It is contemplated that the support plank 12 can rest on the shoulder member or it can be releasably secured to the shoulder member. In a further aspect, the shoulder member defines at least one opening that is adapted to receive a fastener 80 such that the support plank 12 can be releaseably secured to the shoulder member 50.

In one embodiment, the respective base, support and step members are selectively fixed relative to each other by the selective use of the plurality of fasteners 70. In one example, at least one fastener 70 of the plurality of fasteners is adapted to mount therein the first pair of opposing first opening 26 of the base member and the fifth pair 46 of opposing fifth opening of the step member; at least one fastener of the plurality of fasteners is adapted to mount therein one of the at least one second pair of opposing second openings 28 of the base member and the third pair of opposing third openings 36 of the support member; and at least one fastener of the plurality of fasteners is adapted to mount therein one of the at least one fourth pair of opposing fourth openings 38 of the support member and the sixth pair of opposing sixth openings 48 of the step member. In, use, when the fasteners are selectively mounted, the step member 40 is selectively and releasably positioned at one of a plurality of predetermined acute angles with respect to the base member 20. In one example, the plurality of predetermined acute angles comprises angles about that of conventional sloped residential roofs having typical pitches about 27° (6:12 pitch); 34° (8:12 pitch); 40° (10:12 pitch); 45° (12:12 pitch); 51° (15:12 pitch); 56° (18:12 pitch); and 63° (24:12 pitch). However, as one skilled in the art will appreciate, it is contemplated that by selective use of the available openings in the respective base, support and step members, the step member 40 can be positioned with respect to the base member 20 at a predetermined angle between about 10° to about 70°. Thus, it is contemplated that custom roof slopes can be accommodated by the present invention. In one aspect, in the "custom" position, the step member of the barricade bracket has a few degree pitch relative to the horizontal and toward the underlying roof surface.

In one further aspect, the at least one fastener 70 of the plurality of fasteners mounted therein the first pair of opposing first opening 26 of the base member and the fifth pair of opposing fifth openings 46 is adapted to be releasably mounted. Alternatively, the at least one fastener of the plurality of fasteners mounted therein the first pair of opposing first opening 26 of the base member and the fifth pair of opposing fifth openings 46 can be adapted to be non-releasably mounted. It is further contemplated that the at least one fasteners connecting the respective base and step members 20, 40 to the support member 30 are releasably mounted. Exemplary fasteners 70 comprise, but are not meant to be limited to, conventional complementary nut and bolt and a pin and complementary clip that is adapted to releasably mount to a distal end of the pin.

In one exemplified embodiment, the plurality of fasteners 70 can comprise a first shaft 70A, a second shaft 70B, and a third shaft 70C. In this example, the first shaft 70A is sized and shaped adapted to mount therein the first pair of opposing first openings 26 of the base member and the fifth pair of opposing fifth openings 46 in the step member such that the step member 40 can be pivotally moved relative to the base member 20 about an axis of the first shaft. In a further aspect, the second shaft 70B is adapted to mount therein one of the at least one second pair of opposing second openings 28 of the base member and the third pair 36 of opposing third openings of the support member such that the support member 30 can be positioned relative to the base member 20. In this aspect, the third shaft 70C is sized and shaped to mount therein the one of the at least one fourth pair of opposing fourth openings 38 of the support member and the sixth pair of opposing sixth openings 48 of the step member. In use, the third shaft 70C allows the step member 40 to be positioned relative to the support member 30.

In use, and as one skilled in the art will appreciate, when the respective first, second and third shafts 70A, 70B, and 70C are mounted therein the respective openings, the respective base, support and step members are fixed relative to each other. The respective base, support and step members 20, 30, 40 can be selectively positioned with respect to each other such that the step member is selectively and releasably positioned at the plurality of predetermined acute angles with respect to the base member. In certain aspects of the invention, the support member extends substantially transverse to the base member.

For example, and as shown below, for a typical 6:12 pitched roof slope, the first shaft 70A is positioned therein opposing first openings 26 of the base member 20 and the opposing fifth openings 46 in the step member 40. The second shaft 70B is positioned therein opposing second openings 28G of the base member and the opposing third openings 36 of the support member. Finally, the third shaft 70C is fit into the opposing fourth openings 38A of the support member 30 and the opposing sixth openings 48 of the step member 40.

In one example of assembling the barricade bracket for mounting thereon a flat surface, the first shaft 70A is positioned therein opposing first openings 26 of the base member and the opposing fifth openings 46 in the step member. The second shaft 70B is positioned therein opposing second openings 28B of the base member and the opposing third openings 36 of the support member. Finally, the third shaft 70C is fit into the opposing fourth openings 38F of the support member and the opposing sixth openings 48 of the step member. In another example of assembling the barricade bracket for a flat surface, the first shaft 70A is positioned therein opposing first openings 26 of the base member and the opposing fifth openings 46 in the step member. The second shaft 70B is positioned therein opposing second openings 28A of the base member and the opposing third openings 36 of the support member. Finally, the third shaft 70C is fit into the opposing fourth openings 34G of the support member and the opposing sixth openings 48 of the step member. In these embodiments, the step member is positioned at an angle with respect to the underlying flat surface.

Alternatively, in a stowed or closed configuration, the first shaft 70A is positioned therein opposing first openings 26 of the base member and the opposing fifth openings 46 in the step member. The second shaft 70B is positioned therein opposing second openings 28H of the base member and the opposing third openings 36 of the support member. Finally, the third shaft 70C is fit into the opposing fourth openings 38A of the support member and the opposing sixth openings 48 of the step member.

Exemplary mountings of the respective shafts of the invention relative to the openings in the side members of the respective base, support, and step members 20, 30, 40 for typical surface pitches include:

| | Fastener/Shaft Opening Locations | | |
|---|---|---|---|
| Pitch | Base Member Hole # | Step Member Hole # | Support Member Hole # |
| 6/12 | 26-28G | 46-48 | 36-38A |
| 8/12 | 26-28F | 46-48 | 36-38B |
| 10/12 | 26-28E | 46-48 | 36-38C |
| 12/12 | 26-28D | 46-48 | 36-38D |
| 15/12 | 26-28C | 46-48 | 36-38E |
| 18/12 | 26-28B | 46-48 | 36-38F |
| 24/12 | 26-28A | 46-48 | 36-38G |
| Flat | 26-28B | 46-48 | 36-38F |
| | 26-28A | 46-48 | 36-38G |
| Stored | 26-28H | 46-48 | 36-38A |

Of course, as noted above, for non-conventional pitched surfaces, the mounting of the shafts will be varied, as one skilled in the art will appreciate, to position the top plate of the step member near a horizontal position.

The barricade bracket 10 can further comprise a pole 60 and a complementary mount 65. The mount 65 is connected to the outwardly facing portion of the back plate 32 of the support member and extends substantially parallel to the longitudinal axis of the support member. The mount 65 defines a bore 67 that is sized and shaped for complementary receipt of an end portion 62 of the pole 60.

In one aspect, the pole has a first end portion 62A and an opposed second end portion 62B. In this aspect, the first end portion is positioned at an obtuse angle $\gamma$ with respect to the second end portion. The obtuse angle $\gamma$ is between about 130° and 155°, or between about 140° and 145°. Both of the first and second end portions 62A, 62B are adapted to be received in the bore 67 of the mount 65. Thus, in use, either the first or the second end portions are placed therein the mount for the desired orientation of the intermediate portion 62C of the pole relative to the step member.

In a further aspect, the barricade bracket 10 can further comprise a rail assembly 90 for selectively mounting safety rails or barriers, such as, for example, a top rail and/or a midrail, extending therebetween a pair of adjacent barricade brackets 10. In this aspect, the rail assembly 90 comprises a spine member 92 and at least one bracket side member 94 that extends from an edge of the spine member. The spine member 92 defines a passage 96 and the at least one bracket side member defines an opening 98 that is shaped and sized for complementary receipt of a safety rail or barrier, such as, for example, a predetermined dimensioned piece of lumber. In one aspect, the at least one bracket side member 94 comprises an opposed pair of bracket side members 94A, 94B. In this aspect, each bracket side member extends from opposing edges of the spine member. In a further aspect, a first threaded member 97 is mounted to the spine member such that its threaded bore 99 is coaxial with the passage 96.

In another aspect, the rail assembly 90 further comprises a sleeve 100, a second threaded member 110, and a fastener 120. The sleeve defines a conduit 102 that is sized and shaped for mounting to a portion of the exterior surface of the pole that can be selected for the desired height of the rail or barrier relative to the underlying surface. The sleeve 100 further defines an opening 104 in communication with the conduit 102. The second threaded member 110 defines a threaded bore 112 and is mounted thereon the exterior surface of the sleeve. In one aspect, the threaded member 110 is connected to the sleeve 100 such that the threaded bore 112 is coaxial to the opening 104 of the sleeve 92. In a further aspect, the fastener 120, such as, for example and not meant to be limiting, a bolt, has a distal end portion 122 that is adapted to engage the threaded bore 99 of the first threaded member 97 and the threaded bore 112 of the second threaded member 110 such that the distal end of the fastener 120 can selectively engage a portion of the exterior surface of the pole 60 to selectively secure the rail assembly 90 to the pole and such that the sleeve 100 is releasably connected to and positioned substantially parallel to the spine member 92. In this aspect, one will appreciate that the longitudinal axis of the sleeve 100 can be releasably positioned at a desired angle with respect to the longitudinal axis of the spine member 92.

An exemplified procedure for installing the barricade system 2 of the present invention on a 6:12 pitched roof will be described. First, a plurality of barricade brackets 10, as described above, are provided. The slope of the surface is identified so that the respective openings in the base, support and step members 20, 30, and 40 can be identified. In this example, for each barricade bracket, the first shaft 70A is positioned therein the first pair of first openings 26 of the base member 20 and the fifth pair of fifth openings 46 of the step member 40. Next, for each barricade bracket, the second shaft 70B is positioned into a select one of the second pair of second openings 28 (in this example, second opening 28G) of the base member 20 and the third pair of third openings 36 of the support member 30. The third shaft 70C is positioned into a select one of the fourth pair of openings 38 (in this example, fourth opening 38A) of the support member 30 and the sixth pair of fourth openings 48 of the step member 40 for each barricade bracket in the barricade system. One will appreciate that, with the shafts positioned in the selected openings of the respective base, support and step members, the base, support and step members are fixed relative to each other. Further, the step member is selectively positioned at a predetermined angle with respect to the base member. In one embodiment, the predetermined angle is complementary to the slope of the surface such that the step member is substantially horizontal.

Further, the respective anchor plates of two adjacent barricade brackets 10 are releasably mounted to the surface of the roof, such as to the underlying plywood sheathing. In one aspect, the two adjacent barricade brackets are positioned such that the respective top plates 42 of the at least two barricade brackets are coplanar. In one aspect, it is contemplated that the anchor plate 22 of the base member can be mounted to the surface of the roof prior to the mounting of the first shaft 70A, and/or the second shaft 70B, and/or the third shaft 70C. In an alternative aspect, it is contemplated that the anchor plates 22 of the base member should be mounted to the surface of the roof after mounting of the first shaft 70A, and the second shaft 70B, and the third shaft 70C. In this aspect, the barricade bracket can be assembled on the ground and the assembled bracket assembly can be delivered to the mounting surface for installation.

Further, a plurality of poles 60 can be provided such that an end portion of each pole can be mounted therein the mount 65 of the support member. A barrier 14 is mounted to a portion of each pole to prevent a person from progressing therethrough the space between adjacent barricade brackets. In one example, the barrier can be a guard rail formed from a piece of dimensioned lumber. Alternatively, for example and not meant to be limiting, the barrier can comprise rigid metal tubing (such as aluminum, steel, etc.), netting (such as cloth, plastic, rubber, or any other suitable material), or any other suitable barrier means.

In one example, at least one rail assembly 90 is mounted onto each pole 60 such that at least one opposed pair of rail assemblies are formed between two adjacent barricade brackets. A barrier 14, such as a piece of dimensioned lumber, can be placed into the brackets of the respective rail assemblies to form the desired barrier. Still further, in another aspect, a selected piece of dimensioned lumber can be positioned within the respective trough members of the two adjacent barricade brackets 10 to form a toe board 16 for the barricade system 2. In an additional aspect, the support plank 12 is positioned on the respective top plates 42 of the two adjacent barricade brackets to form a work surface that is, in one example, substantially horizontal.

Thus, the barricade system of the present invention allows for the installation of the three-member guard rail required by OSHA standards (top rail 14A, midrail 14B and toe-board 16), as well as the installation of support planks 12 ranging from, for example and not meant to be limiting, 2"×6" to 2"×12". The exemplary 12" wide plank provides for a large walking/working area.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is therefore understood that the invention is not limited to the specific embodiments disclosed herein, and that many modifications and other embodiments of the invention are intended to be included within the scope of the invention. Moreover, although specific terms are employed herein, they are used only in a generic and descriptive sense, and not for the purposes of limiting the described invention.

What is claimed is:

1. A portable barricade bracket for working on a surface, comprising:

a base member having a longitudinal axis, an anchor plate and a pair of opposing base side members extending from opposing edge portions of the anchor plate and defining a first pair of opposing first openings and a spaced at least one second pair of opposing second openings, a support member having a longitudinal axis, a back plate and a pair of opposing support side members extending from opposing edge portions of the back plate and defining a third pair of opposing third openings and a spaced at least one fourth pair of opposing fourth openings;

a step member having a longitudinal axis, a top plate and a pair of opposing step side members extending from opposing edge portions of the top plate defining a fifth pair of opposing fifth openings and a spaced sixth pair of opposing sixth openings;

a first shaft adapted to mount therein the first pair of the base member and the fifth pair of the step member such that the step member can be pivotally moved relative to the base member about an axis of the first pivot shaft;

a second shaft adapted to mount therein one of the second pair of the base member and the third pair of the support member such that the support member can be positioned relative to the base member;

a third shaft adapted to mount therein the one of the fourth pair of the support member and the sixth pair of the step member such that the step member can be positioned relative to the support member, wherein, the respective base, support and step members are fixed relative to each other when the respective first, second and third shafts are mounted therein, and wherein the step member is selectively and releasably positioned at a plurality of predetermined acute angles with respect to the base member;

a pole and a mount, wherein the mount is connected to the back plate of the support member and extends substantially parallel to the longitudinal axis of the support member, and wherein the mount defines a bore that is sized and shaped for complementary receipt of the pole;

a rail assembly comprising:

a spine member having a longitudinal axis and at least one bracket side member extending therefrom an edge of the spine member, wherein the spine member defines a passage, and wherein the at least one bracket defining an opening that is shaped and sized for complementary receipt of a predetermined dimensioned piece of lumber;

a sleeve that defines a conduit that is sized and shaped for slidable engagement with a portion of the pole, wherein the sleeve defines an opening in communication with the conduit;

a threaded member that defines a threaded bore, the threaded member mounted therein the passage of the spine member, wherein the threaded member is connected to the sleeve such that the threaded bore is coaxial to the conduit of the sleeve and such that the sleeve is positioned substantially parallel to the longitudinal axis of the spine member; and a fastener having a distal end that is adapted to engage the threaded bore of the threaded member, whereby the distal end can selectively engage a portion of the pole to selectively secure the rail assembly to the pole.

2. The barricade bracket of claim 1, wherein each base side member defines a first opening and at least one second opening, and wherein the first opening is spaced from the at least one second opening.

3. The barricade bracket of claim 2, wherein the first opening is positioned on a top portion of the base side member, and wherein the at least one second opening is positioned on a bottom portion of the base side member.

4. The barricade bracket of claim 3, wherein the at least one second opening comprises a plurality of second openings.

5. The barricade bracket of claim 4, wherein the plurality of second openings extends linearly substantially parallel to the longitudinal axis of the base member.

6. The barricade bracket of claim 4, wherein each of the plurality of second openings is spaced from an adjacent second opening a predetermined distance.

7. The barricade bracket of claim 6, wherein the predetermined distance is substantially uniform.

8. The barricade bracket of claim 6, wherein the predetermined distance varies between at least two of the second openings of the plurality of second openings.

9. The barricade bracket of claim 6, wherein the predetermined distance is variable.

10. The barricade bracket of claim 1, wherein each support side member defines a third opening and at least one fourth opening, and wherein the third opening is spaced from the at least one fourth opening.

11. The barricade bracket of claim 10, wherein the third opening is positioned adjacent a lower portion of the support side member, and wherein the at least one fourth opening is positioned on an upper portion of the support side member.

12. The barricade bracket of claim 11, wherein the at least one fourth opening comprises a plurality of fourth openings.

13. The barricade bracket of claim 12, wherein the plurality of fourth openings extends linearly substantially parallel to the longitudinal axis of the support member.

14. The barricade bracket of claim 12, wherein each of the plurality of fourth openings is spaced from an adjacent fourth opening a predetermined distance.

15. The barricade bracket of claim 14, wherein the predetermined distance is substantially uniform.

16. The barricade bracket of claim 14, wherein the predetermined distance varies between at least two of the fourth openings of the plurality of fourth openings.

17. The barricade bracket of claim 14, wherein the predetermined distance is variable.

18. The barricade bracket of claim 1, wherein each step side member defines a fifth opening and a sixth opening, and wherein the fifth opening is spaced from the sixth opening.

19. The barricade bracket of claim 18, wherein the fifth opening is positioned adjacent a proximal end of the step side member, and wherein the sixth opening is positioned adjacent a distal end of the support side member.

20. The barricade bracket of claim 1, wherein the support member is positioned substantially normal to the base member.

21. The barricade bracket of claim 1, wherein at least a portion of the base member, the support member and the step member defines a U-shaped channel.

22. The barricade bracket of claim 1, wherein the anchor plate of the base member defines a plurality of anchor openings adapted to receive a fastener for releasable connection to the surface.

23. The barricade bracket of claim 1, wherein the top plate of the step member defines a plurality of mount openings adapted to receive a fastener.

24. The barricade bracket of claim 23, further comprising a shoulder member that defines at least one opening that is adapted to receive the fastener, whereby the shoulder member can be selectively connected to the top plate of the step member.

25. The barricade bracket of claim 24, wherein the shoulder member further comprises a stop that extends substantially transverse therefrom a distal end of the shoulder member.

26. The barricade bracket of claim 1, wherein the pole has a first end portion and a second end portion, wherein the first end portion is positioned at an obtuse angle with respect to the second end portion, and wherein the first and second end portions are adapted to be received therein the bore of the mount.

27. The barricade bracket of claim 1, wherein the at least one bracket side member comprises an opposed pair of bracket side members, each bracket side member extending from opposing edges of the spine member.

28. The barricade bracket of claims 1 or 24, further comprising at least one U-shaped trough member, one side of the trough member being connected to a portion of an upper edge of the support side member, each trough member adapted to seat a board therein such that the board is positioned in a plane substantially parallel to the back plate of the support member.

29. The barricade bracket of claim 1, wherein the first shaft is releasably mounted therein the first pair of the base member and the fifth pair of the step member.

30. The barricade bracket of claim 29, wherein the first shaft comprises a bolt.

31. The barricade bracket of claim 1, wherein the second shaft is releasably mounted therein one of the second pair of the base member and the third pair of the support member.

32. The barricade bracket of claims 1 or 31, wherein the third shaft is releasably mounted therein the one of the fourth pair of the support member and the sixth pair of the step member.

33. The barricade bracket of claim 1, wherein each of second and third shafts comprises a pin and a clip that is adapted to releasably mount to a distal end of the pin.

34. A barricade for working on a work surface comprising:

a base for attaching to the work surface;

a support member coupled to the base and extending substantially perpendicular to the base;

a step member coupled at one end to the base and at an opposite end to the support member, the step member for supporting a walking surface adjacent to the work surface;

at least one pole for coupling to the support member for attaching a railing;

a sleeve coupled to the pole that can slide on the pole for selecting a height of the railing; and a fastener for securing the sleeve to the pole.

35. The barricade of claim 34, wherein the pole has at least one curved end for allowing the railing to extend at an angle from the walking surface.

36. The barricade of claim 34, wherein the pole is removable from the support member.

37. The barricade of claim 34, wherein the support member includes a pole mount along a longitudinal axis of the support member, the pole mount having a bore therein for removably securing the pole.

38. The barricade of claim 34, wherein the pole has a curved end and a straight end for adjusting an angle from which the pole extends relative to the support member.

39. The barricade of claim 34, wherein the support member further includes a U-shaped member for securing a toe board that is separate from the walking surface.

40. A method of erecting a barricade for working on a work surface comprising:

attaching a first and second base to the work surface;

attaching a first support member to the first base so that the first support member extends perpendicular to the first base and a second support member to the second base so that the second support member extends perpendicular to the second base;

attaching one end of a first step member to the first base and another end of the first step member to the first support member;

attaching one end of a second step member to the second base and another end of the second step member to the second support member;

attaching a walking surface on the first and second step members so that the walking surface is adjacent to the work surface;

attaching a first pole to the first support member;

attaching a second pole to the second support member sliding a first sleeve on the first pole until it is set at a desired height for a railing;

sliding a second sleeve on the second pole until it is set at the desired height for the railing; and securing the first and second sleeves to the first and second poles using first and second threaded members, respectively, so that the railing extends between the first and second sleeves.

41. The method of claim 40, wherein each pole has at least one curved end for allowing the railing to extend at an angle from the walking surface.

42. The barricade of claim 40, wherein each pole is removable from its respective support member.

43. The barricade of claim 40, wherein each of the first and second support members include pole mounts along a longitudinal axis of the support members, each of the pole mounts having a bore therein for removably securing the pole.

44. The barricade of claim 40, wherein each pole has a curved end and a straight end for adjusting an angle from which the railing extends relative to the support member.

45. The barricade of claim 40, wherein each support member further includes a U-shaped member for securing a toe board that is separate from the walking surface.

* * * * *

UNITED STATES PATENT AND TRADEMARK OFFICE

CERTIFICATE OF CORRECTION

PATENT NO. : 7,509,702 B2
APPLICATION NO. : 11/257472
DATED : March 31, 2009
INVENTOR(S) : Cantis et al.

It is certified that error appears in the above-identified patent and that said Letters Patent is hereby corrected as shown below:

Column 14,
line 59, "support member" should read -- support member; --.

Signed and Sealed this

Twenty-seventh Day of July, 2010

David J. Kappos

David J. Kappos
*Director of the United States Patent and Trademark Office*